US006112485A

United States Patent [19]

Beyer et al.

[11] Patent Number: 6,112,485

[45] Date of Patent: Sep. 5, 2000

[54] POST-PANEL CONNECTOR ARRANGEMENT

[75] Inventors: Peter J. Beyer, Holland; Mark A. Powell, West Olive; Thomas J. Osterman, Grand Haven, all of Mich.

[73] Assignee: Haworth, Inc., Holland, Mich.

[21] Appl. No.: 09/185,689

[22] Filed: Nov. 4, 1998

[51] Int. Cl.[7] ..... E04B 2/76

[52] U.S. Cl. ..... 52/239; 52/586.1; 52/764; 52/767; 52/775

[58] Field of Search ..... 52/127.6, 127.8, 52/36.6, 239, 476, 779, 586.1, 767, 764, 775, 766, 582.2

[56] References Cited

U.S. PATENT DOCUMENTS

| | | | |
|---|---|---|---|
| Re. 32,890 | 3/1989 | DeFouw et al. . | |
| 2,142,005 | 12/1938 | Roberts . | |
| 3,101,817 | 8/1963 | Radek . | |
| 3,425,171 | 2/1969 | Propst et al. . | |
| 3,517,467 | 6/1970 | Propst et al. . | |
| 3,766,692 | 10/1973 | Stark et al. . | |
| 3,877,191 | 4/1975 | Munsey . | |
| 4,232,183 | 11/1980 | Person . | |
| 4,497,148 | 2/1985 | Lopez . | |
| 4,567,698 | 2/1986 | Morrison . | |
| 4,571,907 | 2/1986 | DeFouw et al. . | |
| 4,914,878 | 4/1990 | Tamaki et al. . | |
| 4,993,205 | 2/1991 | Dull et al. . | |
| 5,024,030 | 6/1991 | Morrison . | |
| 5,054,255 | 10/1991 | Maninfior . | |
| 5,056,285 | 10/1991 | Frascaroli et al. . | |
| 5,058,347 | 10/1991 | Schuelke et al. | 52/239 |
| 5,117,599 | 6/1992 | Voss . | |
| 5,134,826 | 8/1992 | La Roche et al. | 52/239 X |
| 5,176,462 | 1/1993 | Chen . | |
| 5,377,466 | 1/1995 | Insalaco et al. . | |
| 5,606,836 | 3/1997 | Insalaco et al. . | |

*Primary Examiner*—Laura A. Callo
*Attorney, Agent, or Firm*—Flynn, Thiel, Boutell & Tanis, P.C.

[57] ABSTRACT

An interior upright space-dividing wall system wherein portable upright panel assemblies are connected to one another through upright support posts, the latter having a foot for engagement with a floor. Each panel assembly includes a vertically elongate frame member which defines an upright end edge of the respective panel assembly and supports a panel connector member for joining the panel assembly to the support post. The panel connector members include upper and lower jaw members which engage in corresponding openings in a side wall of the support post. The support post includes a pair of connectors at a lower end thereof, each of which supports a lower end of one of the panel assemblies.

25 Claims, 10 Drawing Sheets

POST-PANEL CONNECTOR ARRANGEMENT

FIELD OF THE INVENTION

This invention relates to an upright space-dividing wall system formed from serially connected panel assemblies and, more specifically, to an improved connector arrangement employing intermediate connector posts adapted to cooperate with a panel connector of each panel assembly for securing same to the respective connector post.

BACKGROUND OF THE INVENTION

Numerous panel systems have been developed for use in dividing large open office areas into smaller work spaces or workstations, which panel arrangements typically employ upright space-dividing panels which are serially joined together to define smaller workstations of desired size and configuration. In the known arrangements, the individual panel assemblies have many different structural features. For example, in some arrangements the individual panels are provided with individual support feet or glides which support the weight of the panel on the floor, and adjacent panels are then joined together through intermediate connectors, such as flexible hinges or connector plates, which connectors are not intended to be disposed in load-bearing relationship with the floor. In other arrangements, the adjacent panel assemblies are interconnected through intermediate upright support posts, with the weight of the panels being transferred to the posts, which posts in turn are maintained in load-bearing engagement with the floor. Both types of arrangements are in common usage, and the present invention is concerned with improvements in panel arrangements of the latter-mentioned type. More specifically, in many of the post-type panel arrangements, the intermediate post is provided with appropriate support hooks or grooves which engage cooperating parts on the adjacent panels for providing operative structural and supportive connection of the panels to the support posts. These support hooks and grooves are often provided at the upper and lower ends of intermediate post, and this hence restricts or complicates the flexibility of the system, particularly when adjacent panels are of different heights. In addition, in many of these arrangements the intermediate post is of a significant size, and in some cases the post is dimensioned so that it substantially corresponds in width to the width of the adjacent panel assemblies, and hence the post itself is a visible member and thus must be designed to blend in with the visible side surfaces of the wall system.

In other arrangements, such as that disclosed in U.S. Pat. No. 5,377,466 owned by the Assignee hereof, support hooks and grooves are respectively provided along substantially the entire longitudinal extent of the intermediate post and along the edge of the adjacent panel assembly. This type of multiple-hook arrangement necessarily requires that the hooks and cooperating openings be dimensionally perfect in order to evenly distribute the load of the panel assembly on all of the hooks, but such dimensional relationship cannot be practically achieved.

In many of the post-panel arrangements, the connection between the two panels and the intermediate post requires that both panels be locked or rigidly connected to the post simultaneously. This further complicates the overall assembly process.

Accordingly, it is an object of the invention to provide an improved space-dividing wall system, specifically a wall system of the type wherein panel assemblies at opposite vertical ends are joined to and supported on load-supporting post-like connecting members, which system is desirable in that it is economical and simple to manufacture and has improved structural characteristics.

More specifically, a preferred embodiment of the space-dividing upright wall system according to the invention includes portable upright panel assemblies each having an upright end edge defined at least in part by a vertically elongate frame member, and a vertically elongate support member having a foot portion on a lower end thereof adapted for supportive engagement with a floor. The support member further includes a pair of generally parallel and sidewardly spaced vertically elongate side walls which each have an upper and a lower opening therein disposed in vertically spaced relation with one another. The foot portion of the support member has a pair of outwardly projecting connectors each disposed adjacent a lower portion of one of the side walls for supporting a lower end of one of the panel assemblies. A panel connector is provided on each elongate frame member of the respective panel assemblies, with each panel connector having an upper and a lower jaw member respectively engaged within the upper and lower openings of one of the side walls to fixedly attach the respective panel assembly to the support member.

The preferred embodiment of the wall system according to the invention also includes portable upright panel assemblies each having an upright end edge defined at least in part by a vertically elongate frame member, and a vertically elongate support member having a lower end thereof adapted for supportive engagement with a floor and a pair of generally parallel and sidewardly spaced vertically elongate side walls. A panel connector is releasably attached to the elongate frame member of each panel assembly adjacent an upper end of the frame member, and each panel connector has a pair of relatively opposed movable jaw members disposed to captivate a portion of one of the side walls therebetween to fixedly attach the respective panel assembly to the support member.

The preferred embodiment according to the invention also includes a panel connector arrangement for an interior upright space-dividing wall system including an upright panel assembly having an upright end edge defined at least in part by a vertically elongate frame member. The frame member defines therein a vertically elongate compartment and upper and lower openings which open into the compartment. A vertically elongate support member is provided having a lower end thereof adapted for supportive engagement with a floor and a pair of generally parallel and sidewardly spaced vertically elongate side walls, one of which side walls has an upper and a lower opening therein disposed in vertically spaced relation with one another. A panel connector is disposed in the compartment and includes relatively movable upper and lower jaw members. The upper jaw member is engaged within the upper openings of the frame member and the support member and the lower jaw member is engaged within the lower openings of the frame member and the support member to fixedly attach the panel assembly to the support member.

Other objects and purposes of the invention will be apparent to persons familiar with arrangements of this general type upon reading the following specification and inspecting the accompanying drawings.

Figure 1:
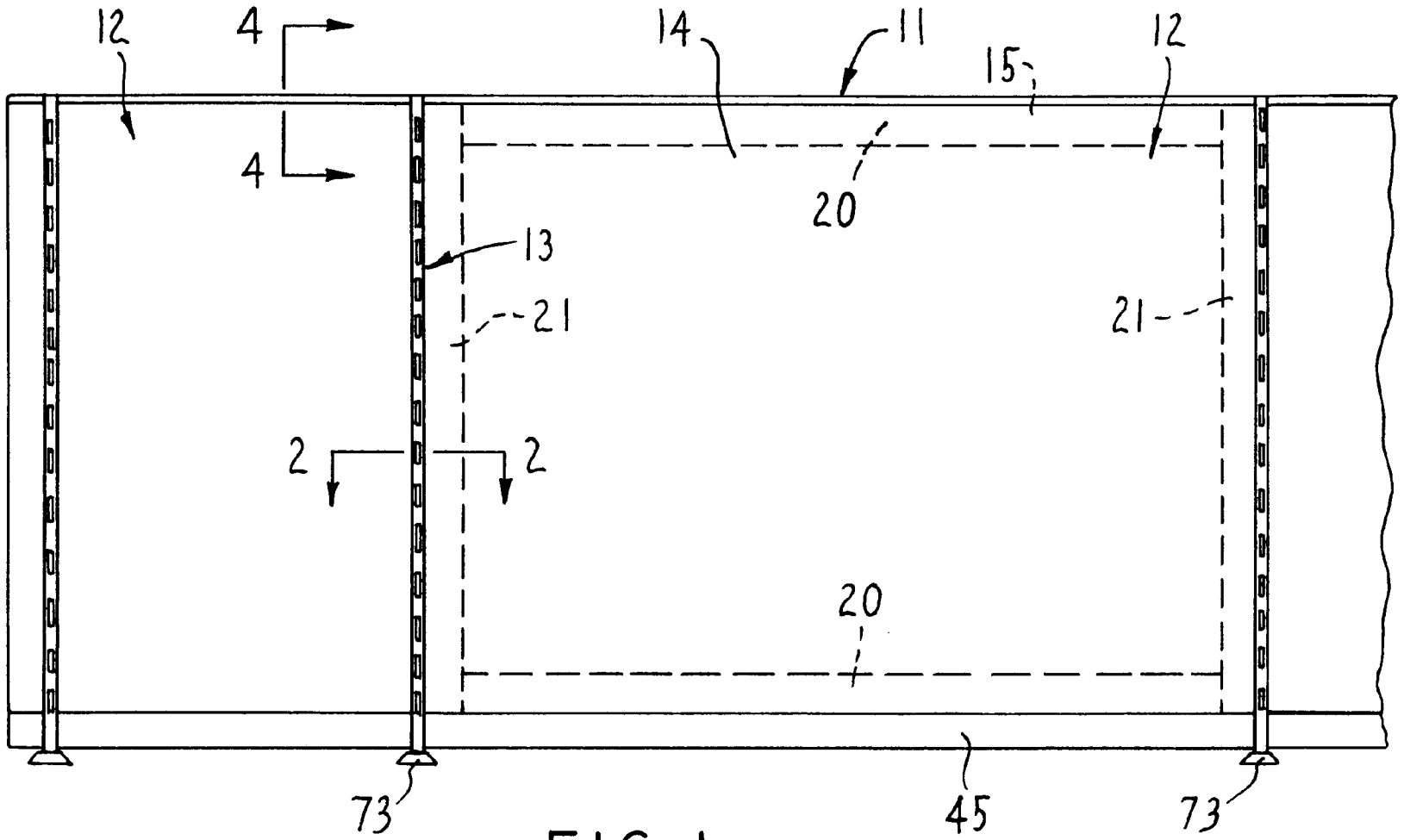
FIG. 1 is a side elevational view which illustrates several panel assemblies joined together to define at least part of an upright space-dividing wall system according to the present invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, there is illustrated an upright space-dividing wall system 11 according to the present invention, which system 11 is formed by a plurality of upright space-dividing panel assemblies 12 which are joined together in a series arrangement to define individual workstations. The panel assemblies 12 are typically joined in either aligned (i.e. end-to-end) relationship, or in perpendicular relationship with end edges of two panel assemblies 12 being disposed closely adjacent one another, such arrangements being conventional. The individual panel assemblies 12 typically have a height which is significantly less than floor-to-ceiling height, whereby the panel assemblies 12 are supported on and project upwardly from the floor, with upper edges of the panel assemblies 12 being spaced downwardly a significant distance from the ceiling. The sizes of such panel assemblies, in terms of widths and heights, are conventional.

In the space-dividing wall system 11 of the present invention, each pair of adjacent aligned panel assemblies 12 is connected together by a post-type connector arrangement 13, as discussed below.

Figure 4:
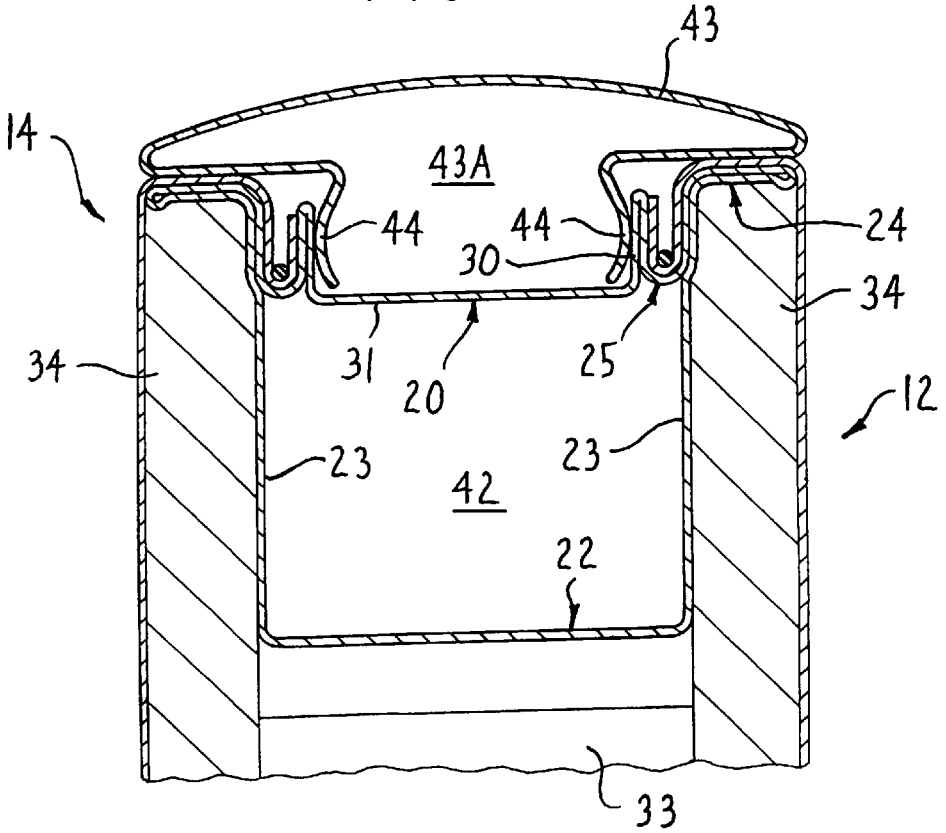
FIG. 4 is an enlarged, fragmentary cross-sectional view taken generally along line 4—4 of FIG. 1.

Each panel assembly 12 includes a main upright panel member 14 having large width and height dimensions as compared to the thickness dimension thereof. The main panel member 14 includes a generally rectangular and ring-like frame 15 defined by generally parallel and horizontally elongated top and bottom frame members or rails 20 which are rigidly joined together at opposite ends thereof by generally parallel and vertically elongated side frame members or rails 21. The frame members 20 and 21, in accordance with the illustrated embodiment, are each of generally identical or similar cross-section and, as illustrated in FIGS. 2 and 4, are of a generally outwardly-opening channel-like configuration.

Figure 2:
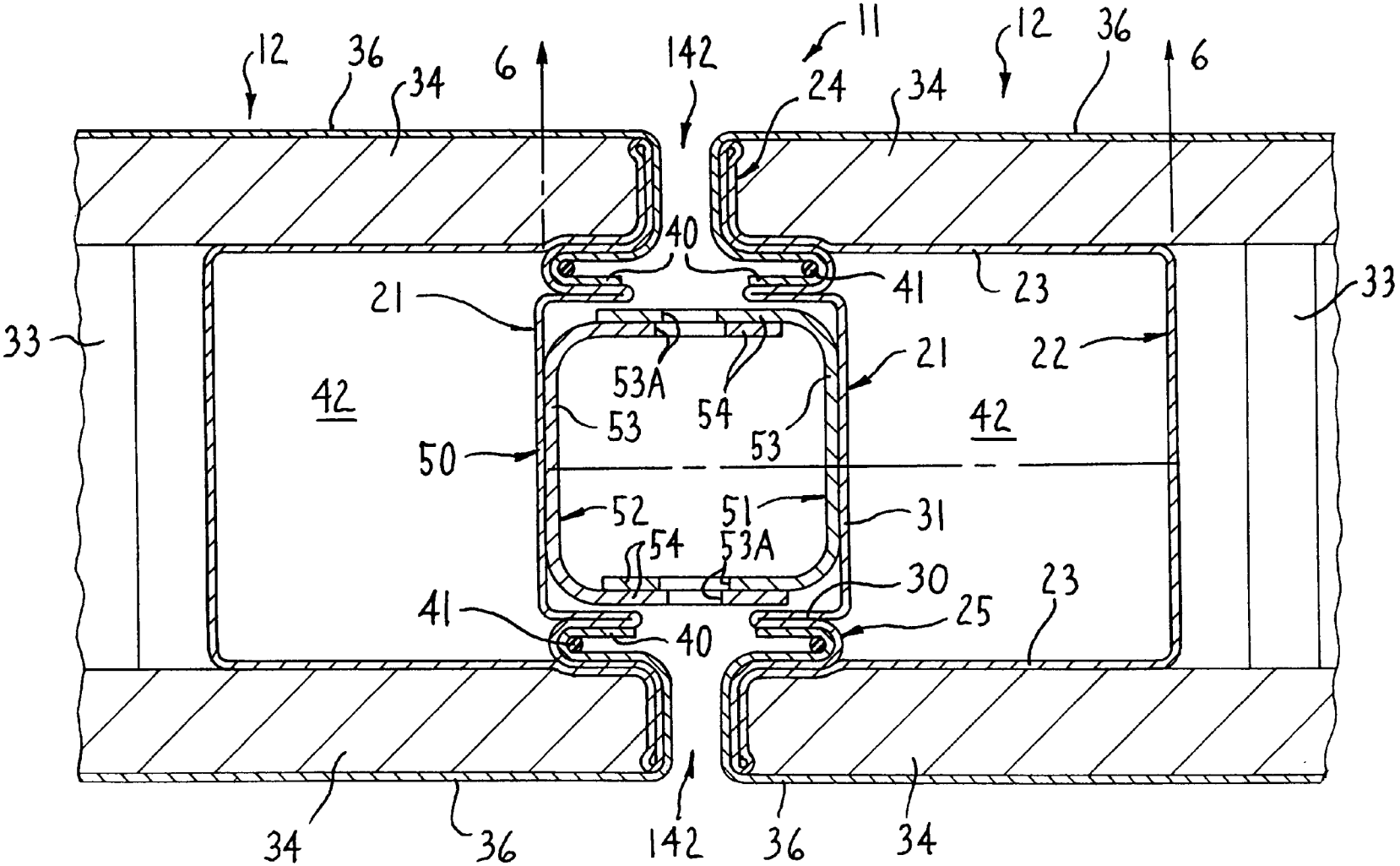
FIG. 2 is an enlarged, fragmentary cross-sectional view taken generally along line 2—2 of FIG. 1.
Figure 3:
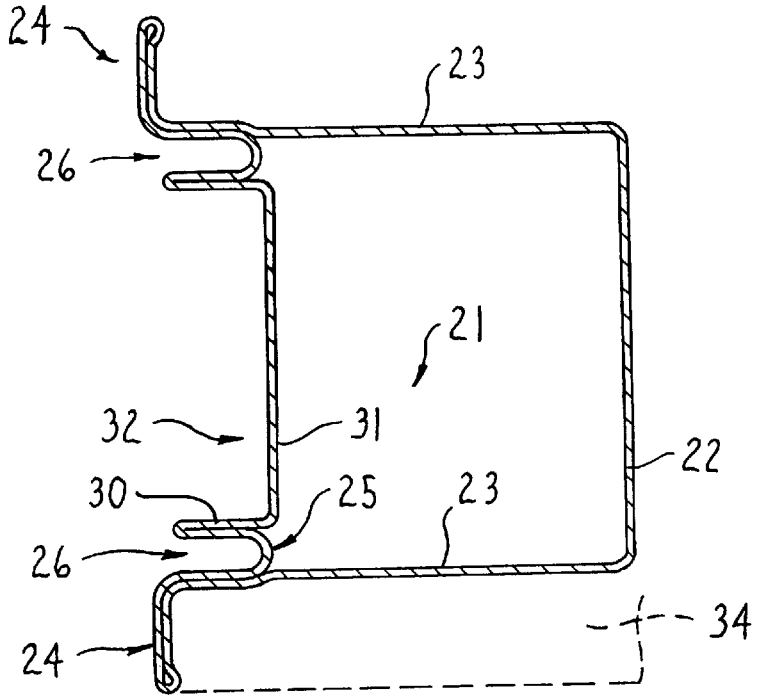
FIG. 3 is an enlarged fragmentary cross-sectional view illustrating the configuration of the panel frame member.

With reference to FIGS. 2 and 3, each frame member 20 and 21 includes an inner wall 22 having fixed thereto a pair of generally parallel and outwardly projecting side walls 23. Each side wall 23, at an outermost edge thereof, is bent outwardly through a substantially 90° angle to form a flange 24 which defines the end edge of the panel member 14. The flanges 24 extend along all of the frame members 20 and 21 and hence define a generally rectangular ring-like rim. Each flange 24 is in turn joined to a generally U- or channel-shaped part 25 which is spaced sidewardly and inwardly from the respective flange 24. U-shaped parts 25 define therein a channel or groove 26 which extends throughout the elongated length of the respective frame member and opens outwardly. Each U-shaped part 25 is bent over upon itself to form a wall 30 generally parallel to side walls 23, and an outer wall 31 generally parallel to inner wall 22 preferably extends between and interconnects the walls 30. Outer wall 31 and walls 30 together define an outwardly-opening mouth or channel 32.

Figure 6:
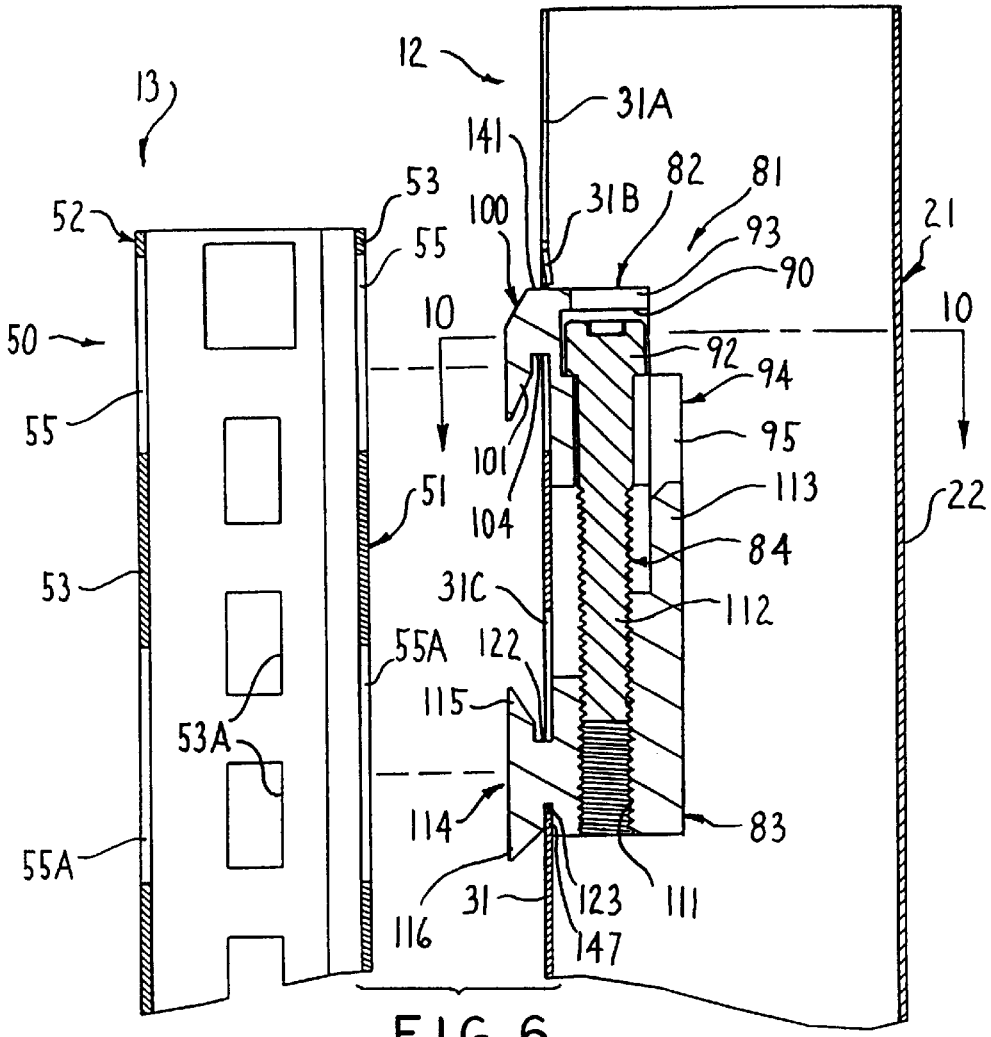
FIG. 6 is an enlarged, fragmentary cross-sectional view of the upper ends of the connector post and panel assembly taken generally along line 6—6 of FIG. 2, but showing the panel assembly removed from the connector post.

As shown in FIG. 6, the outer wall 31 of each side frame member 21, adjacent an upper end thereof, has an upwardly opening slot 31A and a pair of resilient retaining tabs 31B each positioned sidewardly of slot 31A (only one of which is shown in FIG. 6), which slot 31A extends downwardly a limited distance from the upper end of the frame member 21. Outer wall 31 also includes a lower opening 31C spaced downwardly a small distance from the bottom of slot 31A for a purpose as discussed below.

The ring-like frame 15, as defined by frame members 20 and 21, surrounds and confines a core structure 33 which fills the interior of the frame 15 (FIG. 2). The core structure 33 in the illustrated embodiment comprises a sheet of paper or expanded honeycomb, although other conventional core materials can be utilized if desired. The frame 15 and core structure 33 are sandwiched between a pair of plate-like side members 34, the latter being of generally rectangular configuration so as to cover substantially the entire opposite sides of the panel member 14. The side members 34 directly overlie and are preferably adhesively secured to opposite side surfaces of the frame members 20 and 21 (i.e. side walls 23) and core structure 33, with the edges of the side members 34 being confined generally within the rim defined by the flanges 24 as illustrated in FIGS. 2 and 4. These flanges 24 preferably project sidewardly by an extent which substantially corresponds to the thickness of the side members 34.

The plate-like side members 34 are preferably a one-piece lamina of what is conventionally referred to as mineral or fiber board. Such lamina is a mixture of fibers (such as wood fibers) contained within a particle-type filler, with the filler particles and fibers being suitably secured by a binder. This fiberboard provides a relatively rigid and relatively stiff lamina but possesses physical properties which enable it to function in a highly desirable manner as a tack board in that small pins and the like can be inserted into the board and retained therein. This fiberboard also provides desirable acoustical properties, specifically sound-absorption properties, and is preferably provided with small perforations (not shown) extending inwardly from the outer side thereof, which perforations extend only partway through the thickness of the board.

The side members 34 are additionally preferably covered by a thin layer of fiberglass (not shown) which extends over the outer surface of the side member 34. The fiberglass layer is typically of lesser thickness than the side member 34.

The main panel member 14 is additionally provided with exterior coverings over the laminate defined by the side members 34 and the fiberglass layers, which coverings in the illustrated embodiment comprise large sheets of thin but flexible fabric 36 which are stretched across and entirely cover the outer vertical side faces of the panel member 14. This fabric sheet 36 has edge portions 40 which wrap exteriorly around each of the frame member flanges 24 and fold into the groove 26, with the fabric edge portion 40 being suitably secured within groove 26 by a retaining element 41. The retaining element 41 is, conventionally, of an elongate and elastomeric construction so as to extend throughout the grooves 26 to maintain the fabric sheet 36 in a taut condition. This technique for securing a fabric to a space-dividing panel is conventional. Alternately, the fabric edge portion 40 can be adhesively secured within groove 26.

Each frame member 20 and 21 includes an interior compartment 42 which may be utilized for storage or routing of cables, such as communication cables. As shown in FIG. 4, the top of the panel member 14 can have a removable top cap 43 which spans the width of the top edge of the panel member 14 and closes off the mouth 32. The resulting channel 43A may also be used for storage of communication cables along the top frame member 20 whereby the cables are capable of being fed from channel 43A and into compartments 42 of side frame members 21. The top cap 43 in the illustrated arrangement preferably includes a pair of sidewardly spaced and downwardly projecting resilient legs 44 which project into the mouth 32 and resiliently engage the opposed walls 30 to securely but releasably attach the top cap 43 to the top frame member 20.

The lower edge of the panel member 14 preferably has a raceway arrangement 45 (FIG. 1) associated therewith and extending therealong. The raceway arrangement 45 has a width which substantially corresponds to the width of panel member 14 and defines an interior channel (not shown) which extends lengthwise along the lower edge of the respective panel member 14. This channel defined within raceway arrangement 45 enables cables, such as electrical or communication cables, to be disposed therein so as to extend lengthwise along the wall system 11.

Considering now the post-type connector arrangement 13, and referring specifically to FIGS. 2 and 5–7, this arrangement 13 includes a vertically elongate and generally tubular panel connector post 50 which is designed to connect between the side frame members 21 of two adjacent panel members 14. The connector post 50 in the illustrated embodiment includes a pair of vertically elongate and generally U-shaped members 51 and 52 each having a base portion 53 and a pair of parallel legs 54 extending outwardly and generally perpendicularly from the respective base portions 53. Each leg 54 preferably includes a plurality of vertically-elongate slot-like openings 53A extending therethrough, which openings 53A are spaced along substantially the entire vertical extent of post 50. The U-shaped members 51 and 52 are arranged so that the legs 54 of each member 51 and 52 substantially overlap and lie against one another in superimposed relation whereby the openings 53A of legs 54 align with one another and provide access into the interior of the connector post 50. The U-shaped members 51 and 52 are preferably fixedly attached to one another, such as by welding. Alternatively, the panel connector post 50 may be formed from a one-piece tubular component.

The connector post 50 also includes a pair of openings 55 and 55A (FIG. 6) located adjacent the top end of post 50, which openings 55 and 55A preferably extend through the base portion 53 of each U-shaped member 51 and 52. The upper and lower openings 55 and 55A of U-shaped member 51 are respectively horizontally aligned with the upper and lower openings 55 and 55A of the opposite U-shaped member 52. In addition, the vertical dimension of the lower openings 55A is preferably slightly greater than the vertical dimension of the upper opening 55 for a purpose as discussed below.

Figure 5:
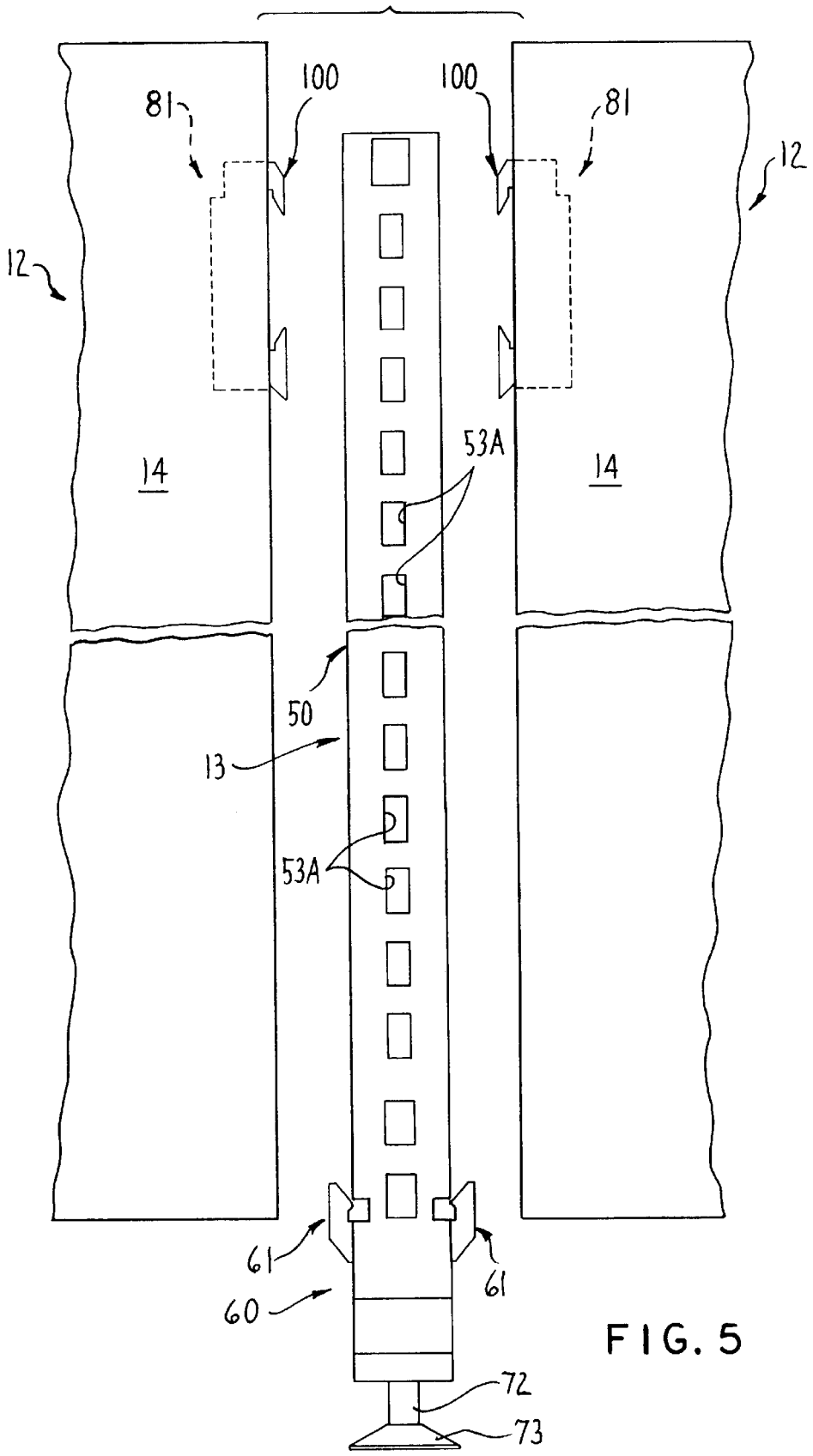
FIG. 5 is an enlarged, fragmentary, exploded, side elevational view of two adjacent panel assemblies and an intermediate connector post.
Figure 7:
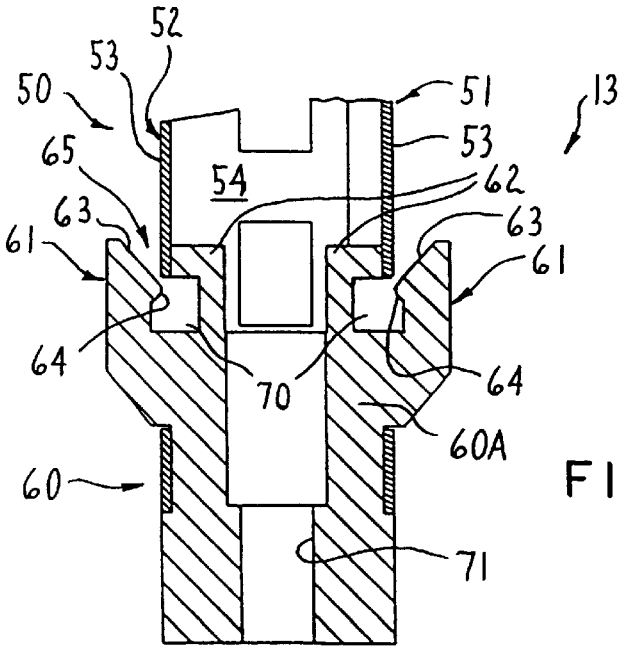
FIG. 7 is an enlarged fragmentary cross-sectional view similar to FIG. 6 but showing only the lower end of the connector post.

As shown in FIGS. 5 and 7, the connector post 50 has a lower end or foot 60 having a base body 60A and a pair of connectors or hooks 61 which preferably extend horizontally outwardly and then vertically upwardly from base body 60A. The connectors 61 are located on opposite sides of base body 60A and adjacent the lowermost ends of the respective U-shaped members 51 and 52, which lowermost ends are preferably fixed to an outwardly and generally horizontally extending flange 62 of base body 60A. Each connector 61 preferably includes a bevel 63 at an upper portion thereof, the lower end of which bevel 63 terminates at a corner which, in the illustrated embodiment is an inwardly projecting bead 64 which extends along substantially the entire horizontal width of the connector 61. The lowermost ends of each of the U-shaped members 51 and 52 and the adjacent bead 64 together define an access opening 65 of a horizontally extending and sidewardly opening channel 70 formed in base body 60A, which channel 70 is located inwardly from the respective connector 61. The channel 70 is of a generally square cross-sectional configuration (FIG. 7) with the access opening 65 being located at an upper and outwardly oriented corner thereof.

The base body 60A of foot 60 also includes a centrally oriented and vertically extending opening 71 for fixedly captivating the upper end of a vertically downwardly projecting support post or rod 72 (FIG. 5), the latter having its lower end fixed to an enlarged foot or glide 73 adapted for direct supportive engagement with the floor. The opening 71 and the outer surface of the support post 72 are preferably threaded (not shown) so that the support post 72 can be vertically adjusted to provide for height adjustment of the post 50 relative to the glide 73.

Figure 8:
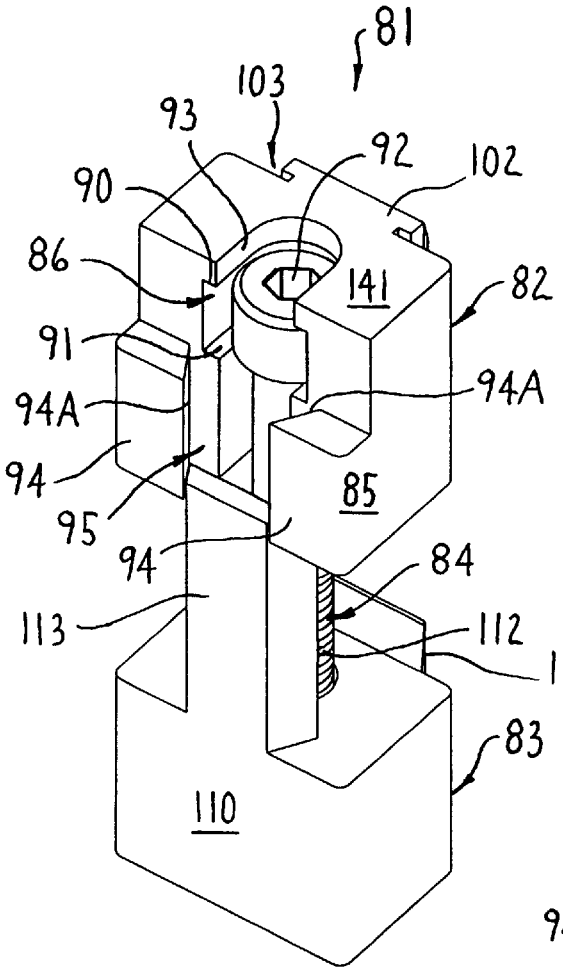
FIG. 8 is a perspective view of the panel connector in isolation.
Figure 9:
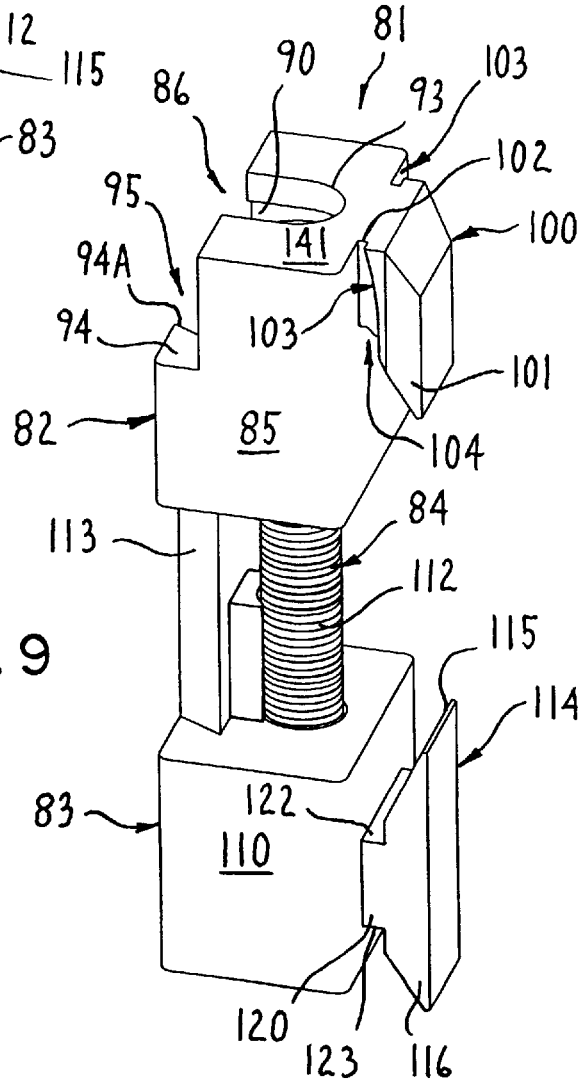
FIG. 9 is an additional perspective view of the panel connector in isolation.

With reference to FIGS. 6, 8 and 9, the post-type connector arrangement 13 additionally includes a panel lock or connector 81 supported on each respective panel assembly 12 adjacent each upper corner thereof. The panel connector 81 has upper and lower jaw members 82 and 83 which are slidably movable toward and away from one another by means of a threaded screw connector 84 as discussed in detail below.

The upper jaw member 82 is embodied by a base body 85 which defines therein a sidewardly and upwardly opening U-shaped recess 86 in which screw connector 84 is located. The base body 85 has an opposed pair of U-shaped shoulders 90 and 91 which define an upper portion of recess 86 and captivate therebetween an enlarged head 92 of screw connector 84. The upper shoulder 90 also defines an opening 93 which provides access to the head 92 of screw connector 84. Base body 85 additionally includes a pair of outwardly projecting guide members 94 having facing beveled side surfaces 94A. The surfaces 94A are sidewardly spaced from one another and define a vertically extending channel 95 therebetween.

Figure 10:
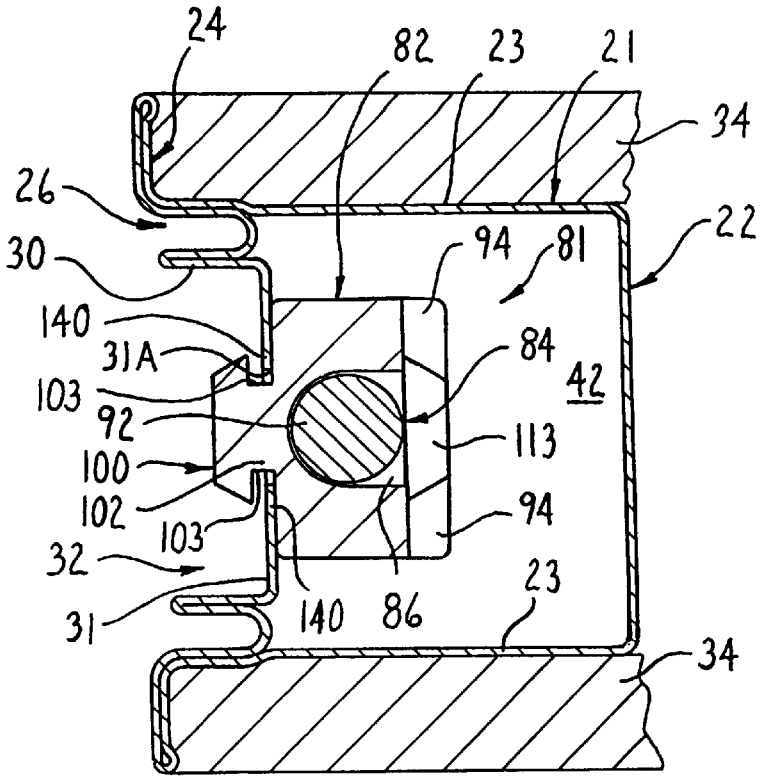
FIG. 10 is a cross-sectional view of the panel connector and the respective side frame member without the fabric covering thereon taken generally along line 10—10 in FIG. 6.

As shown in FIGS. 6 and 9, upper jaw member 82, at the upper end thereof, includes an outwardly projecting L-shaped hook part 100 having a downwardly extending leg 101. Leg 101 of hook part 100 is joined to base body 85 by a neck or base portion 102. A vertically extending, channel-like groove 103 is formed at either side of neck portion 102. The grooves 103 have a slight taper as they project vertically so as to be of narrowest width at the top, and of widest width at the bottom (FIG. 9). The horizontal width of neck portion 102 between the grooves 103 is preferably similar to, but slightly less than, the horizontal width of upper slot 31A of outer wall 31 of side frame member 21 (FIG. 10). As shown in FIGS. 6 and 9, neck portion 102, along with base body 85 and leg 101, define a horizontally extending, downwardly opening channel 104 located inwardly of leg 101. The channel 104 has a width similar to and slightly larger than the thickness of base portion 53 of U-shaped member 51 or 52 plus the thickness of outer wall 31 of side frame member 21.

With reference to FIGS. 6, 8 and 9, the lower jaw member 83 has a generally rectangular base body 110 having a threaded hole 111 extending vertically and centrally therethrough, in which hole 111 the lower portion of a shaft 112 of screw connector 84 is threadingly engaged so as to attach the upper and lower jaw members 82 and 83 to one another. An elongate slide member 113 preferably is cantilevered upwardly from an upper surface of base body 110 for engagement within channel 95 formed between the guide members 94 of upper jaw member 82. The sides of slide member 113 are preferably beveled in a complementary manner relative to the beveled surfaces 94A of guide members 94 so that slide member 113 is sidewardly captivated within channel 95 but movable vertically therewithin.

As shown in FIG. 9, a generally T-shaped hook part 114 projects outwardly from base body 110 from a side thereof opposite slide member 113. The hook part 114 includes a base or neck portion 120 projecting outwardly from base body 110 and a pair of generally vertically extending legs 115 and 116 respectively cantilevered upwardly and downwardly from neck portion 120. Neck portion 120, along with base body 110 and leg 115, define an upper horizontally extending U-shaped channel 122, and along with base body 110 and leg 116 define a lower horizontally extending U-shaped channel 123. The upper channel 122 has a width similar to, but slightly larger than, the thickness of base portion 53 of U-shaped members 51 or 52 plus the thickness of outer wall 31 of side frame members 21. Further, the lower channel 123 has a width similar to but slightly larger than the thickness of outer wall 31 of side frame members 21.

Figure 12:
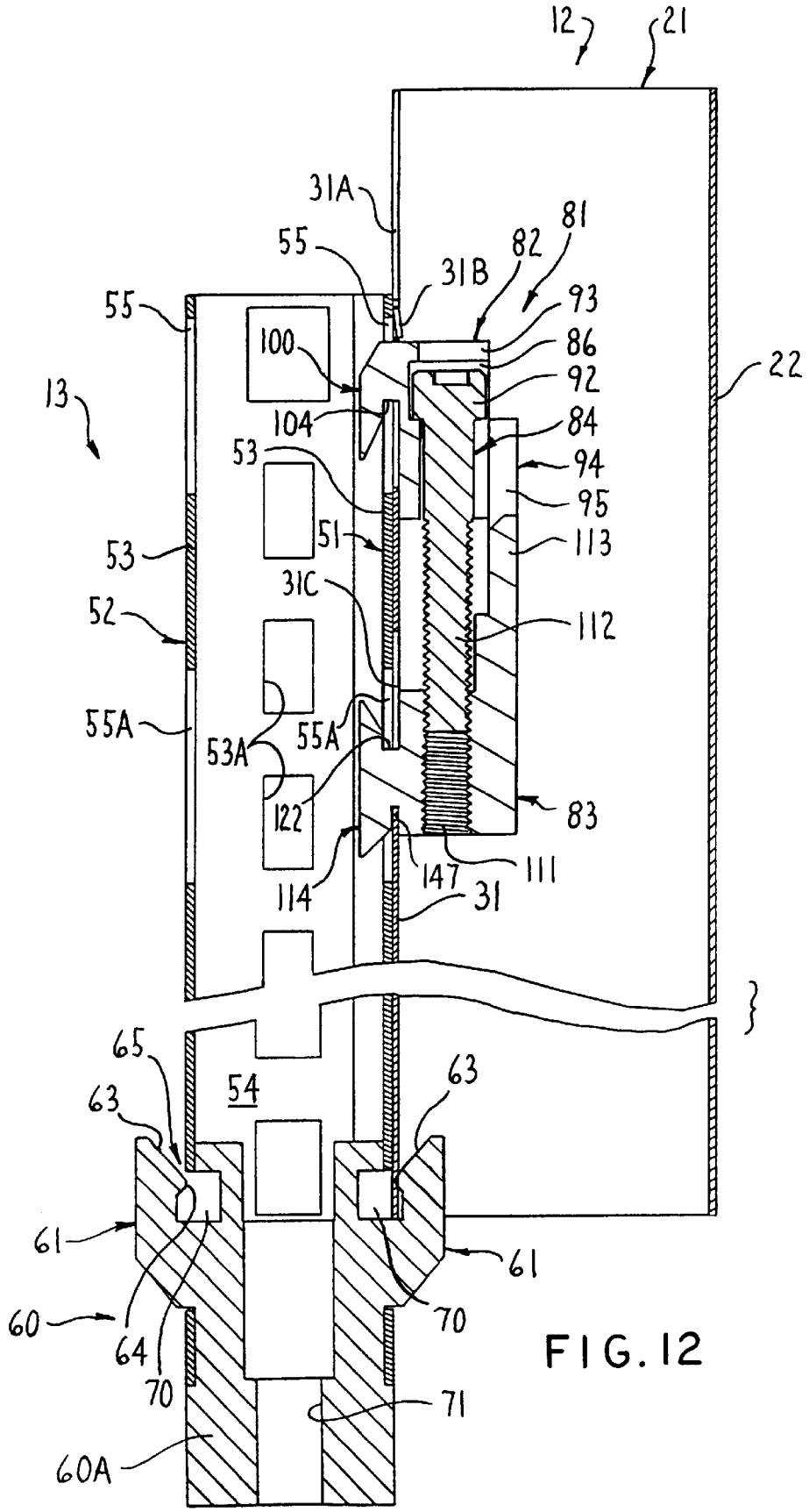
FIG. 12 is a fragmentary, cross-sectional view of the connector post with a panel assembly mounted thereon, with the upper panel connector in the open configuration.
Figure 13:
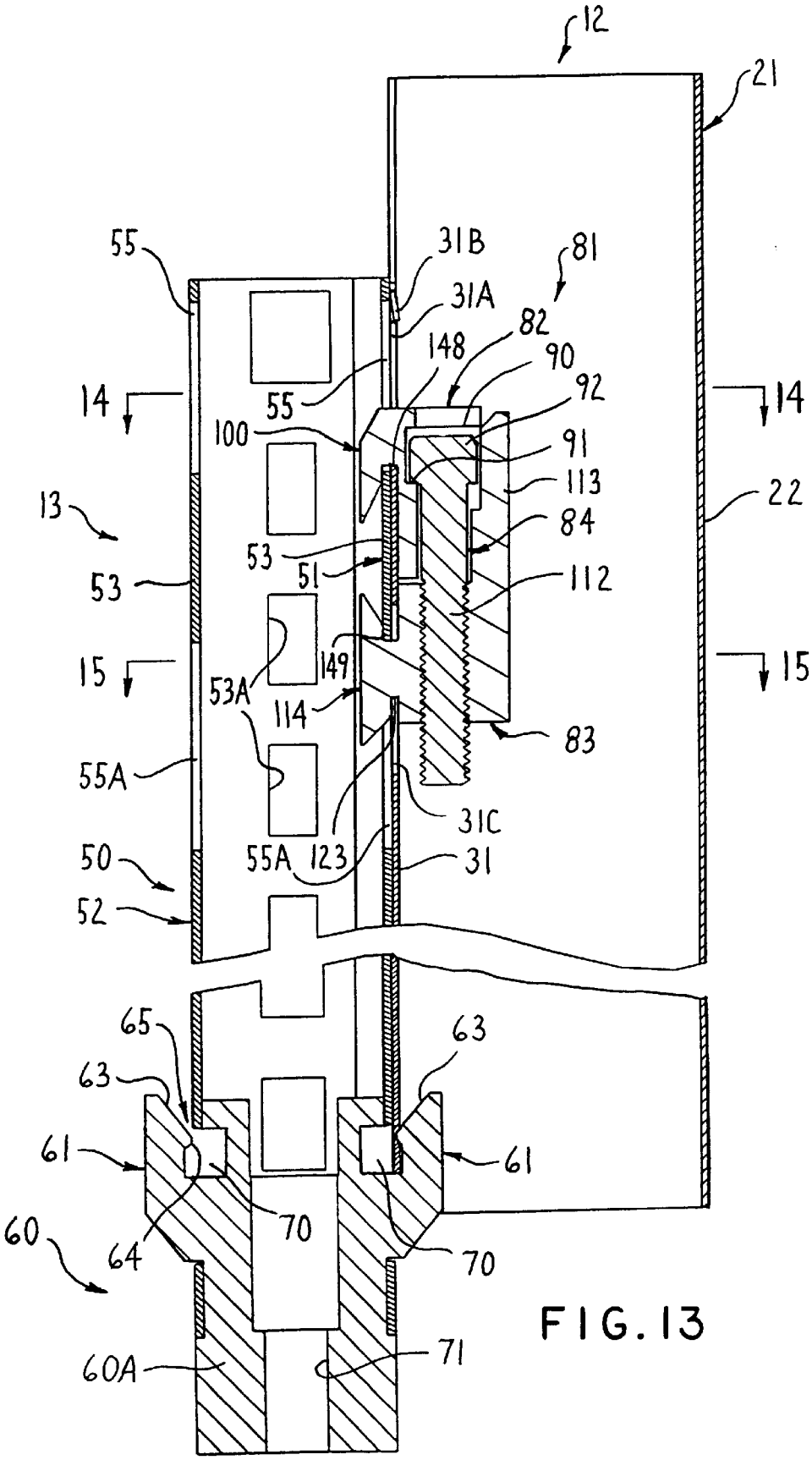
FIG. 13 is a view similar to FIG. 12, but with the panel connector in the closed configuration.
Figure 14:
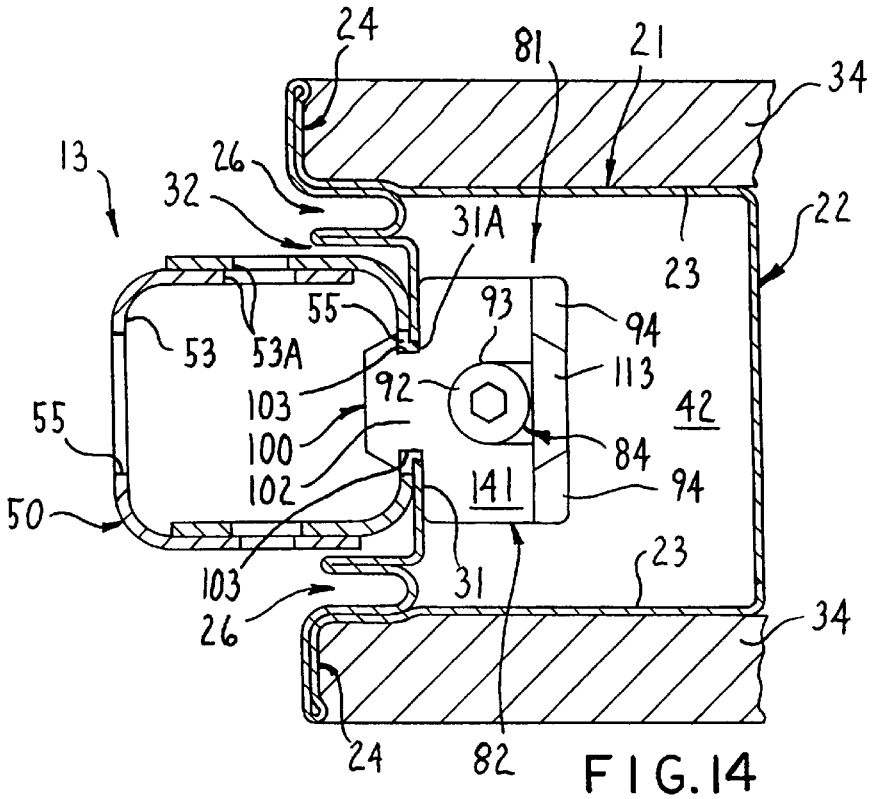
FIG. 14 is a cross-sectional view taken generally along line 14—14 in FIG. 13.
Figure 15:
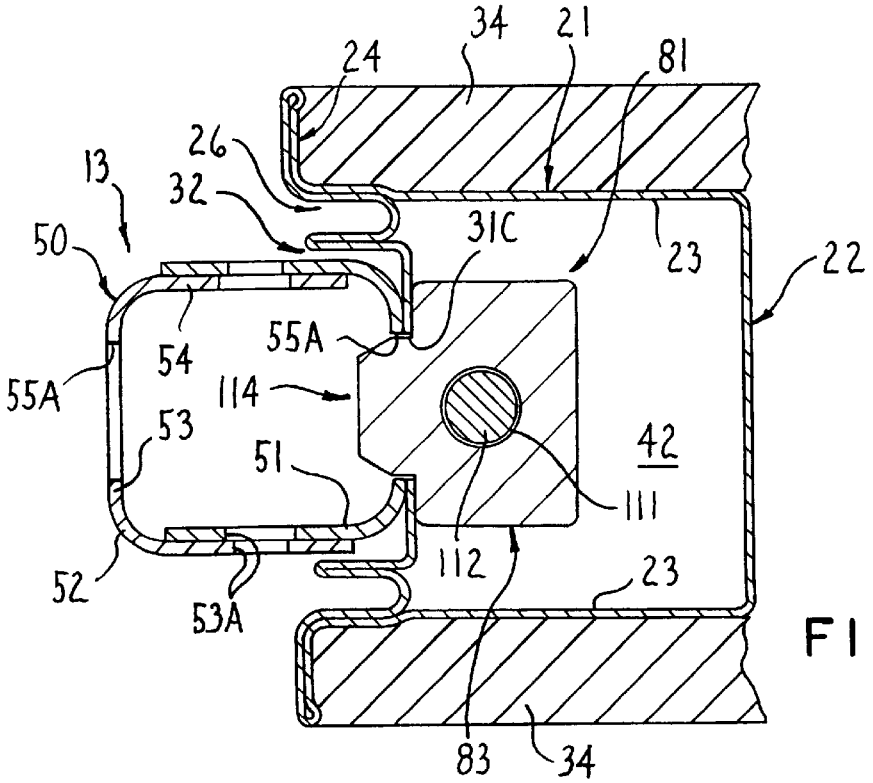
FIG. 15 is a cross-sectional view taken generally along line 15—15 of FIG. 13.

The positions of upper and lower jaw members 82 and 83 relative to one another are adjustable between open and closed configurations as shown in FIGS. 12 and 13, respectively. For example, holding the upper jaw member 82 stationary and turning screw connector 84 in a clockwise direction causes movement of lower jaw member 83 towards upper jaw member 82 to effect a closed configuration whereby base bodies 85 and 110 substantially abut one another, and turning screw connector 84 in the opposite counterclockwise direction causes movement of lower jaw member 83 away from upper jaw member 82 to effect an open configuration whereby upper and lower jaw members 82 and 83 are spaced apart from one another.

The upper and lower jaw members 82 and 83 of panel lock 81 maybe one-piece, monolithic, rigid components which may be manufactured as die-formed aluminum members. In addition, screw connector 84 maybe formed of metal.

The assembly of the wall system 11, and the structural and functional cooperation of the individual panel assemblies 12 with the post-type connector arrangement 13 will now be briefly described to ensure a complete understanding of the invention.

The panel members 14 are generally preassembled in the factory, and in this regard, a panel lock 81 is also typically assembled onto each upper corner of the respective panel member 14 prior to shipping as follows. The panel lock 81, in its open configuration as shown in FIGS. 6 and 12, is preferably assembled onto each side frame member 21 by inserting the panel lock 81 into the upper open end of compartment 42 of side frame member 21 and simultaneously horizontally aligning the hook part 100 of upper jaw 82 with slot 31A of outer wall 31, and sliding the panel lock 81 downwardly so that side edges 140 of outer wall 31 which define slot 31A (FIG. 10) engage in the respective vertical grooves 103 of upper jaw member 82. Continued sliding of panel lock 81 downwardly in slot 31A eventually vertically aligns hook part 114 of lower jaw member 83 with lower opening 31C of outer wall 31. Hook part 114 of lower jaw member 83 is then inserted into opening 31C, as permitted by the tapered shape of grooves 103, and further downward movement of panel lock 81 relative to side frame member 21 causes the edge 147 of outer wall 31 which defines the lower extent of lower opening 31C (FIGS. 6 and 12) to seat in the bottom channel 123. This downward sliding of upper jaw member 82 along slot 31A also causes tabs 31B to deflect down, and then snap out over the upper surface 141 of upper jaw member 82 to act as a vertical stop so as to securely position panel lock 81 on the panel assembly 12, for example prior to shipping.

Figure 11:
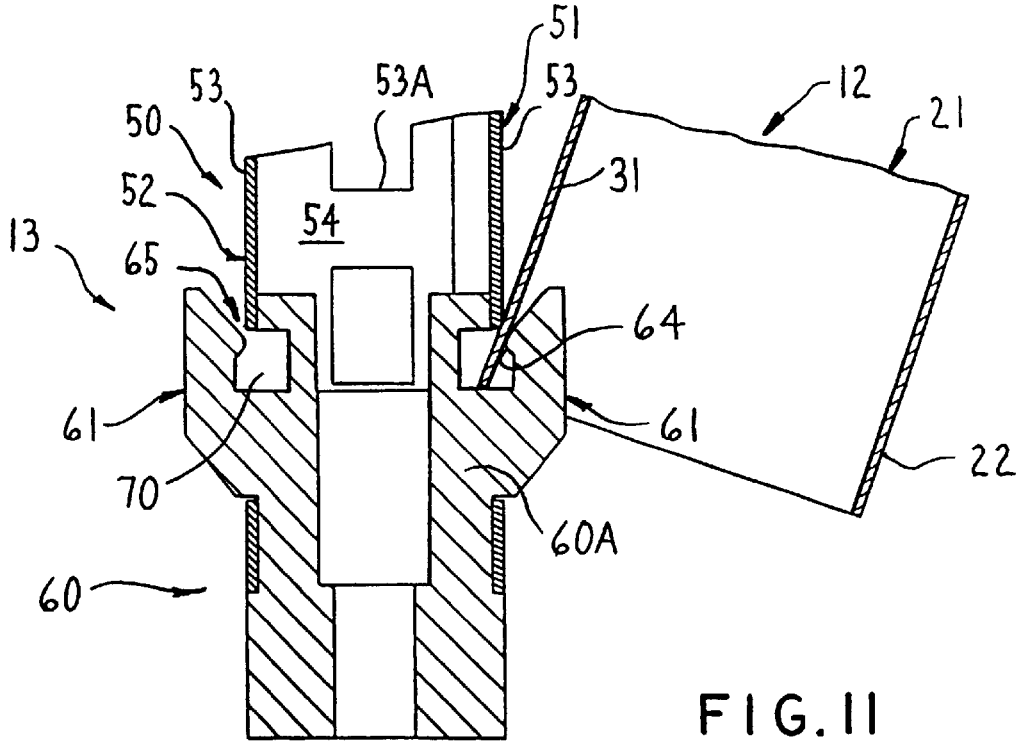
FIG. 11 is a view similar to FIG. 7, but showing the side frame member of the panel assembly inserted into the lower connector of the intermediate connector post.

To secure two or more panel members 14 in aligned series relationship such as depicted in FIG. 1, a single connector post 50 is provided and cooperates directly between the adjacent upright end edges of two panel members 14 to rigidly join same to one another. To connect two such panel members 14, and with reference to FIG. 11, the lower corner of one panel member 14 is tilted or angled relative to the connector post 50 and the lowermost edge of outer wall 31 of side frame member 21 is inserted into the access opening 65 of channel 70. During this insertion step, the bevel 63 of foot connector 61 preferably serves as a lead in or guide which assists in seating outer wall 31 in channel 70. As the side frame member 21 is fully inserted into channel 70, the panel member 14 is relatively pivoted upwardly towards the connector post 50 as shown in FIG. 12, and the hook parts 100 and 114 of panel lock 81 align with and are inserted into the correspondingly sized respective upper and lower openings 55 and 55A of connector post 50. In this regard, the vertical location of lower opening 55A along connector post 50 and the size of lower opening 55A ensures that the hook part 114 of lower jaw member 83 will pass through lower opening 55A only when the lower edge of side frame member 21 is properly seated against the bottom wall of the channel 70. Further, the bead 64 of foot 60 abuts the inwardly facing surface of outer wall 31 and provides a substantially zero-clearance snug fit of outer wall 31 in access opening 65.

To further attach the panel member 14 to the connector post 50, a tool, for example a conventional Allen wrench or screwdriver is inserted into the open upper end of side frame member 21 and into opening 93 of upper jaw member 82 to turn screw connector 84 and lower the upper jaw member 82 towards lower jaw member 83. The screw connector 84 is turned until the edge 148 (FIG. 13) of outer wall 31 (which edge 148 defines the lower extent of slot 31A) seats in channel 104 which then causes the lower jaw member 83 to move upwardly toward upper jaw member 82 until the edge 149 of connector post 50 (which edge 149 defines the upper extent of lower opening 55A) seats in channel 122. With the panel lock 81 in its closed configuration as shown in FIG. 13, the panel member 14 is now rigidly attached to the connector post 50 with the side frame member 21 in substantially abutting contact with connector post 50. In this locked position, the top jaw member 82 applies a clamping force vertically downwardly on the edge frame 21, and the lower jaw member 83 applies a clamping force vertically upwardly on the post 50.

A second panel member 14 can now be attached to the opposite side of connector post 50 in a similar manner as that described above, resulting in the two panel members 14 being directly rigidly joined together in adjacent and aligned relation. Further, the weight of the panel members 14 is transmitted to a support surface such as a floor solely due to the engagement of the glides or feet 73 associated with the post-like panel connector arrangements 13, which glides 73 can be vertically adjusted to providing for desired leveling of the wall system 11 in a conventional manner (FIG. 5).

With each pair of aligned panel members 14 joined through a single connector post 50, the connector post 50 is sandwiched within a generally rectangular opening substantially defined by the mouths 32 of the side frame members 21 of the two adjacent panel members 14 so as to be effectively hidden between the panel members 14, the latter having the vertical end edges thereof disposed closely adjacent and separated from one another solely by a small vertically extending clearance gap or slot 142, as illustrated by FIG. 2. This narrow slot 142 between adjacent panel members 14 is directly aligned with the hanger openings 53A provided in the connector post 50 so that conventional hangers associated with furniture components or accessories such as cabinets or the like can be positioned adjacent the side surface of the panel member 14 with the hangers of the accessory projecting through the slot 142 for engagement within the openings 53A. In this fashion, the weight of the components is transmitted directly to the panel connecting posts 50 which in turn directly supportingly engage the floor, and hence the weight or load of the accessories is not imposed on the panel members 14. This enables the strength of the panel members 14 to be minimized and permits more economical construction thereof.

Further, the panel connecting arrangement in accordance with the invention is also suitable for attaching panel assemblies 12 of different heights to connecting posts 50 simply by providing additional pairs of upper and lower openings 55 and 55A in post 50 at the appropriate height to accommodate standard panel heights, for example panel heights of approximately 88, 64, 48 and 36 inches.

Further, the panel connecting arrangement according to the invention permits attachment of the panel members 14 to a connector post 50 one at a time which simplifies assembly, as compared to conventional panel assemblies which require simultaneous connection of both panel members to the post.

In a situation wherein one of the panel members 14 defines the free edge of a panel run, then in such case the free edge of the last panel member 14 is provided with a connector post 50 for supporting the free edge of the last panel member 14. To close off the connector post 50 located at the free edge, an end cover (not shown) is provided having a size and configuration compatible with the panel members 14 so as to provide a finished appearance.

When two panel assemblies 12 are to be disposed in adjacent but right angled relationship so as to define a corner, then the side frame member 21 associated with each panel assembly 12 is provided with a connector post 50 fixedly secured thereto, which connector post 50 is secured to the side frame member 21 in the same manner described above, and the two panel members 14 and the respective connector posts 50 are then disposed in closely adjacent but right angled relationship. A corner member (not shown) having flanges which cooperate with the openings 55 and 55A in the respective connector posts 50 may be provided to create a fixed structural connection directly between the two corner-related connector posts 50. A corner cover (not shown) configured for attachment to the respective connector posts 50 may also be provided so as to provide the corner with a finished appearance.

Although a particular preferred embodiment of the invention has been disclosed in detail for illustrative purposes, it will be recognized that variations or modifications of the disclosed apparatus, including the configuration and rearrangement of parts, lie within the scope of the present invention.

The embodiments of the invention in which an exclusive property or privilege is claimed are defined as follows:

1. An interior upright space-dividing wall system comprising:

first and second portable upright panel assemblies each having an upright end edge defined at least in part by a vertically elongate frame member, and a pair of oppositely facing and generally planar vertically enlarged side surfaces which extend transversely relative to the respective said frame member;

a vertically elongate support member interposed between the respective frame members of said first and second panel assemblies, said support member having a foot portion adjacent lower end thereof adapted for supportive engagement with a floor and a pair of generally parallel and sidewardly spaced vertically elongate side walls, each said side wall having an upper and a lower opening therein disposed in vertically spaced relation with one another, and said lower end of said support member including a pair of outwardly projecting connectors for supporting a lower end of one of said first and second panel assemblies; and a pair of panel connectors, one of said panel connectors being supported on said elongate frame member of said first panel assembly and the other said panel connector being supported on said elongate frame member of said second panel assembly, each said panel connector having an upper and a lower jaw member which are movable relative to one another, said upper and lower jaw members of said one panel connector being respectively engaged within said upper and lower openings of one of said side walls to fixedly attach said first panel assembly to said support member, and said upper and lower jaw members of said other panel connector being respectively engaged within said upper and lower openings of the other said side wall to fixedly attach said second panel assembly to said support member such that said vertically enlarged side surfaces of said second panel assembly are disposed in generally coplanar aligned relation with the respective said vertically enlarged side surfaces of said first panel assembly.

2. The wall system of claim 1 wherein each said upper jaw member includes a hook part having a base portion projecting generally horizontally from the respective said elongate frame member and a vertically extending leg cantilevered downwardly from said base portion, and each said lower jaw member includes a hook part having a base portion projecting generally horizontally from the respective said elongate frame member and a pair of vertically projecting legs respectively cantilevered upwardly and downwardly from said lower jaw base portion.

3. The wall system of claim 2 wherein each said elongate frame member includes an upwardly opening slot therein and an opening spaced downwardly from said slot, said upper jaw base portion of the respective said panel connector projecting through said slot and said upper opening of the corresponding said side wall and said lower jaw base portion projecting through said opening of the respective said frame member and said lower opening of the corresponding said side wall.

4. The wall system of claim 1 wherein said panel connectors each include an elongate member movably connecting said upper and lower jaw members such that manipulation of said elongate member permits vertical movement of the respective upper and lower jaw members relative to one another into an open configuration wherein said upper and lower jaw members are disposed a substantial distance from one another and a closed configuration wherein said upper and lower jaw members are disposed closely adjacent one another.

5. The wall system of claim 4 wherein said upper and lower jaws of said panel connectors in said closed configuration respectively clamp said elongate frame members of said first and second panel assemblies against the corresponding said side walls of said support member.

6. The wall system of claim 1 wherein each said elongate frame member includes an upwardly opening slot therein and an opening spaced downwardly from said slot, a portion of said upper jaw of the respective panel connector projecting horizontally through said slot and a portion of said lower jaw of the respective panel connector projecting horizontally through said frame member opening, each said elongate frame member further including a retaining member disposed adjacent both the respective said slot and the respective said upper jaw member prior to attachment of said panel assembly to said support member to prevent disengagement of said panel connector from said elongate frame member.

7. The wall system of claim 1 wherein each said panel connector is supported adjacent a top end of the respective panel assembly, said lower end of said support member has an upright base body and said connectors each project generally horizontally outwardly and then vertically upwardly from said base body to define a generally horizontally extending channel between said base body and the respective connector, said lower ends of said first and second panel assemblies being seated in the respective said channels.

8. The wall system of claim 7 wherein an upper end of each said connector includes a bead which projects toward said base body and engages said elongate frame member of the respective panel assembly to provide a snug fit of said lower end thereof against the respective said side wall.

9. The wall system of claim 7 wherein an upper end of each said connector is beveled and angles inwardly and downwardly relative to the respective said side wall to guide said lower end of the respective said panel assembly into the respective said channel.

10. The wall system of claim 1 wherein said support member includes a pair of generally parallel and sidewardly spaced vertically elongate face walls arranged transversely relative to said side walls thereof, each said face wall having a plurality of hanger-receiving openings therein for supporting at least one accessory component, said hanger-receiving openings being disposed in vertically spaced relationship so as to define a generally vertically elongate row, and said elongate frame members of said first and second panel assemblies defining vertically extending and opposed channels spaced inwardly from said vertically enlarged side surfaces of said panel assemblies so that said support member is effectively confined within the opposed channels, and said first and second panel assemblies having vertical end surfaces which extend transversely relative to the respective said vertically enlarged side surfaces, said vertical end surfaces of the respective panel assemblies being spaced a small horizontal distance apart so as to define a narrow and vertically elongate gap therebetween which aligns with said row of hanger-receiving openings to provide access thereto.

11. The wall system of claim 1 wherein said support member is a separate and distinct component from said first and second panel assemblies and the respective said frame members thereof.

12. An interior upright space-dividing wall system comprising:

first and second portable upright panel assemblies each having an upright end edge defined at least in part by a vertically elongate frame member and a pair of oppositely facing and generally planar vertically enlarged side surfaces which extend transversely relative to the respective said frame member;

a vertically elongate support member interposed between the respective frame members of said first and second panel assemblies, said support member having a pair of generally parallel and sidewardly spaced vertically elongate side walls; and a pair of panel connectors, one of said panel connectors being releasably attached to said elongate frame member of said first panel assembly and the other said panel connector being releasably attached to said elongate frame member of said second panel assembly, each said panel connector having a pair of movable jaw members, said jaw members of said one panel connector being disposed to captivate a portion of one of said side walls of said support member therebetween to fixedly attach said first panel assembly to said support member and said jaw members of the other said panel connector being disposed to captivate a portion of the other said side wall of said support member to fixedly attach said second panel assembly to said support member such that said vertically enlarged side surfaces of said second panel assembly are disposed in generally coplanar aligned relation with the respective said vertically enlarged side surfaces of said first panel assembly.

13. The wall system of claim 12 wherein said jaw members of said panel connectors are upper and lower jaw members, said upper jaw member of each said panel connector projects through a pair of generally horizontally aligned upper openings respectively disposed in the corresponding said side wall and the corresponding said elongate frame member, and said lower jaw member of each said panel connector projects through a pair of generally horizontally aligned lower openings respectively disposed in the corresponding said side wall and the corresponding said elongate frame member.

14. The wall system of claim 13 wherein said side wall portion of each said side wall is disposed between and respectively defines lower and upper edges of said upper and lower openings of said side wall, and a portion of each said elongate frame member is disposed between and respectively defines lower and upper edges of said upper and lower openings of said elongate frame member, said upper and lower jaw members of each said panel connector being movably positionable a substantial distance from one another to define an open configuration during assembly of the corresponding said panel assembly and said support member and being movably positionable adjacent one another for captivating the corresponding said side wall portion and the corresponding said elongate frame member portion therebetween such that said elongate frame member portion is superimposed on said side wall portion.

15. The wall system of claim 12 wherein said panel connectors are each disposed adjacent an upper end of both the respective panel assembly and said support member, and said support member adjacent a lower end thereof is configured for supporting a lower edge portion of each said first and second panel assembly.

16. The wall system of claim 12 wherein said support member includes a pair of generally parallel and sidewardly spaced vertically elongate face walls arranged transversely relative to said side walls thereof, each said face wall having a plurality of hanger-receiving openings therein for supporting at least one accessory component, said hanger-receiving openings being disposed in vertically spaced relationship so as to define a generally vertically elongate row, and said elongate frame members of said first and second panel assemblies defining vertically extending and opposed channels spaced inwardly from said vertically enlarged side surfaces of said panel assemblies so that said support member is effectively confined within the opposed channels, and said first and second panel assemblies having vertical end surfaces which extend transversely relative to the respective said vertically enlarged side surfaces, said vertical end surfaces of the respective panel assemblies being spaced a small horizontal distance apart so as to define a narrow and vertically elongate gap therebetween which aligns with said row of hanger-receiving openings to provide access thereto.

17. The wall system of claim 12 wherein each said frame member defines horizontally sidewardly opening upper and lower openings therein, said upper and lower openings of each of said frame members being generally horizontally aligned with, and disposed in juxtaposed face-to-face relation with, the respective said upper and lower openings of the corresponding said side wall of said support member, said upper and lower jaw members of each said panel connector being respectively engaged within said upper and lower openings of said frame member and the corresponding said side wall to fixedly attach the respective said panel assembly to said support member.

18. A panel connector arrangement for an interior upright space-dividing wall system, said arrangement comprising:

an upright panel assembly having an upright end edge defined at least in part by a vertically elongate frame member defining therein a vertically elongate compartment, said frame member having an upper and a lower opening therein both opening horizontally sidewardly into said compartment and being disposed in vertically spaced relation with one another;

a vertically elongate support member having a lower end adapted for supportive engagement with a floor and a vertically elongate side wall, said side wall having an upper and a lower opening therein disposed in vertically spaced relation with one another and opening horizontally sidewardly, said upper and lower openings of said side wall being generally horizontally aligned with, and disposed in juxtaposed face-to-face relation with, the respective said upper and lower openings of said frame member; and a panel connector disposed in said compartment and having relatively movable upper and lower jaw members, said upper jaw member being engaged within said upper openings of said frame member and said side wall of said support member and said lower jaw member being engaged within said lower openings of said frame member and said side wall of said support member to fixedly attach said panel assembly to said support member.

19. The arrangement of claim 18 wherein said support member adjacent said lower end thereof is configured for supporting a lower edge portion of said panel assembly.

20. The arrangement of claim 18 wherein said panel connector is disposed adjacent a top end of both said panel assembly and said support member, said panel connector including an elongate member movably connecting said upper and lower jaw members to one another and permitting movement of said upper and lower jaw members into an open configuration wherein said upper and lower jaw members are disposed a substantial distance from one another and permitting movement of said upper and lower jaw members into a closed configuration wherein said upper and lower jaw members are disposed closely adjacent one another and clamp said frame member of said panel assembly against said side wall of said support member.

21. The arrangement of claim 18 wherein said support member is a separate and distinct component from said panel assembly and said frame member thereof, and said vertically elongate compartment is defined solely by and within said frame member.

22. An upright space-dividing wall system comprising:

a pair of upright, vertically elongate structural elements respectively defining part of a vertically enlarged, upright panel assembly and a vertically elongate post, each said structural element defining an upper and a lower open region and an intermediate wall portion disposed therebetween; and a separate locking device supported on one of said structural elements and having relatively movable upper and lower jaws, said upper and lower jaws respectively extending through said upper and lower open regions of the respective said structural elements and upon movement of said upper and lower jaws toward one another into a closed position, said upper jaw engaging only an upper edge of said wall portion of one of said structural elements to apply a downwardly directed force thereon and said lower jaw engaging only a lower edge of said wall portion of the other said structural element to apply an upwardly directed force thereon, and a pair of vertically opposed stop surfaces defined on the respective said structural elements which engage one another at least in said closed position of said locking device so as to oppose the downwardly directed force of said upper jaw on said one structural element and secure said one structural element to said other structural element.

23. The wall system of claim 22 wherein said upper and lower open regions of each said structural element open generally horizontally sidewardly such that said upper and lower regions of said one structural element are respectively disposed in face-to-face relation with said upper and lower regions of said other structural element.

24. An upright space-dividing wall system comprising:

first and second portable upright panel assemblies each having a vertically elongate and rigid end frame defining therein an upper and a lower opening disposed in vertically spaced relation with one another and separated by a wall portion;

an elongate post interposed between said end frames of said first and second panel assemblies, said post having a lower end defining a pair of stops thereon configured for supporting respective lower edges of said first and second panel assemblies, said post having first and second sidewardly spaced, vertically elongate side walls each disposed adjacent one of said end frames of said first and second panel assemblies, each said first and second side wall having an upper and a lower opening therein disposed in vertically spaced relation with one another and separated by a wall portion, said upper and lower openings of said first and second side walls being generally horizontally aligned with the respective said upper and lower openings of the adjacent said end frame; and a pair of panel connectors each having upper and lower jaw members which are movable between open and closed positions, one said panel connector being supported on said end frame of said first panel assembly and the other said panel connector being supported on said end frame of said second panel assembly, said lower jaw member of each said panel connector projecting sidewardly through said aligned lower openings of the corresponding said end frame and the corresponding said side wall and, in said closed position of said jaw members, said lower jaw member engaging only a lower edge of said wall portion of said post to apply an upwardly directed force thereon, and said upper jaw member of each said panel connector projecting sidewardly through said aligned upper openings of the corresponding said end frame and the corresponding said side wall and, in said closed position of said jaw members, said upper jaw member engaging only an upper edge of said wall portion of said end frame to apply a downwardly directed force thereon and urge said lower edge of the corresponding said panel assembly against the corresponding said stop of said post to attach said panel assembly thereto.

25. The wall system of claim 24 wherein said upper jaw member of each said panel connector defines therein a horizontally extending channel which opens sidewardly and downwardly and receives therein said upper edge of said wall portion of said end frame, and said lower jaw member of each said panel connector defines therein a horizontally extending channel which opens sidewardly and upwardly and receives therein said lower edge of said wall portion of said post.

* * * * *